US005158280A

United States Patent [19]

Sanchez

[11] Patent Number: 5,158,280

[45] Date of Patent: Oct. 27, 1992

[54] LETTER PROCESSING APPARATUS

[75] Inventor: Jose R. Sanchez, Briarcliff Mannor, N.Y.

[73] Assignee: Pitney Bowes Inc., Stamford, Conn.

[21] Appl. No.: 665,057

[22] Filed: Mar. 6, 1991

[51] Int. Cl.[5] ..... B65H 5/02

[52] U.S. Cl. ..... 271/274; 198/725

[58] Field of Search ..... 271/34, 35, 122, 198, 271/273, 274, 275, 277; 198/861.1, 813, 836.2, 613, 725, 626.6, 721

[56] References Cited

U.S. PATENT DOCUMENTS

| | | | |
|---|---|---|---|
| 2,921,351 | 1/1960 | Momm | 222/504 |
| 3,618,934 | 5/1970 | Germuska | 271/274 |
| 4,585,432 | 4/1984 | Marysse | 198/626.6 X |
| 4,620,807 | 11/1986 | Polit | 271/274 X |
| 4,670,081 | 6/1987 | Takahashi et al. | 198/626.6 X |
| 4,821,049 | 4/1989 | Eckl | 271/274 X |
| 4,903,954 | 2/1990 | Robertson et al. | 271/274 X |

*Primary Examiner*—H. Grant Skaggs
*Assistant Examiner*—CarolLynn Druzbiak
*Attorney, Agent, or Firm*—Donald P. Walker; Melvin J. Scolnick

[57] ABSTRACT

Apparatus for processing letters, comprising: an elongate deck; structure for feeding respective letters in a downstream path of travel extending longitudinally along the deck, the feeding structure including a pair of axially parallel spaced rollers, the feeding structure including an endless belt looped about the rollers and disposed in engagement therewith; and structure for supporting the feeding structure, the supporting structure including a stationary frame, the supporting structure including a pair of elongate parallel-spaced support members pivotably attached to the frame and extending therefrom into overhanging relationship with the deck, and the feeding structure removably connected to the support members.

16 Claims, 2 Drawing Sheets

LETTER PROCESSING APPARATUS

BACKGROUND OF THE INVENTION

The present invention is generally concerned with apparatus for processing letters and more particularly with apparatus for processing mixed thickness letters.

This application is related to U.S. patent application Ser. No. 07/665,056 (Applicant's case file C-774) for An Article of Manufacture For Use In Letter Processing Apparatus, filed concurrently herewith by the same inventor.

As shown in U.S. Pat. No. 3,951,257 for a Mail Transporting Mechanism issued Apr. 20, 1976 to Anthony Storace, there has been provided apparatus for transporting letters which includes a frame for supporting a plurality of rollers, and includes a friction belt stretched over the rollers for conveying letters through the apparatus as the rollers turn. Some of the rollers are supported by yoke assemblies, which are spring biased to urge the belt into contact with the letters and to accommodate varying thicknesses of letters. In addition, the yoke assemblies are pivotable into and out of engagement with the belt, by means of a slidable bar carried by the frame, to permit both removal and replacement of the belt and to permit freeing letters jammed against the belt.

Thus it is known in the art to provide letter processing apparatus which includes a belt endlessly looped about a plurality of rollers and includes structures for removably mounting the belt, accommodating mixed thickness letters and clearing letter jam conditions.

Experience has shown that apparatus of the type shown in the aforesaid patent is costly to manufacture and maintain. Accordingly:

An object of the invention is to provide simplified apparatus for processing mixed thickness letters;

Another object is to provide letter feeding apparatus which is removably connected to apparatus for clearing letter jam conditions;

Another object is to provide letter feeding apparatus which is removably connected to structure for supporting the apparatus; and Another object is to provide an article of manufacture for use in letter processing apparatus.

SUMMARY OF THE INVENTION

Apparatus for processing letters, comprising: an elongate deck; means for feeding respective letters in a downstream path of travel extending longitudinally along the deck, the feeding means including a pair of axially parallel spaced rollers, the feeding means including an endless belt looped about the rollers and disposed in engagement therewith; and means for supporting the feeding means, the supporting means including a stationary frame, the supporting means including a pair of elongate parallel-spaced support members pivotably attached to the frame and extending therefrom into overhanging relationship with the deck, and the feeding means removably connected to the support members.

BRIEF DESCRIPTION OF THE DRAWINGS

As shown in the drawings wherein like reference numerals designate like or corresponding parts throughout the several views.

DESCRIPTION OF THE PREFERRED EMBODIMENTS

Figure 1:
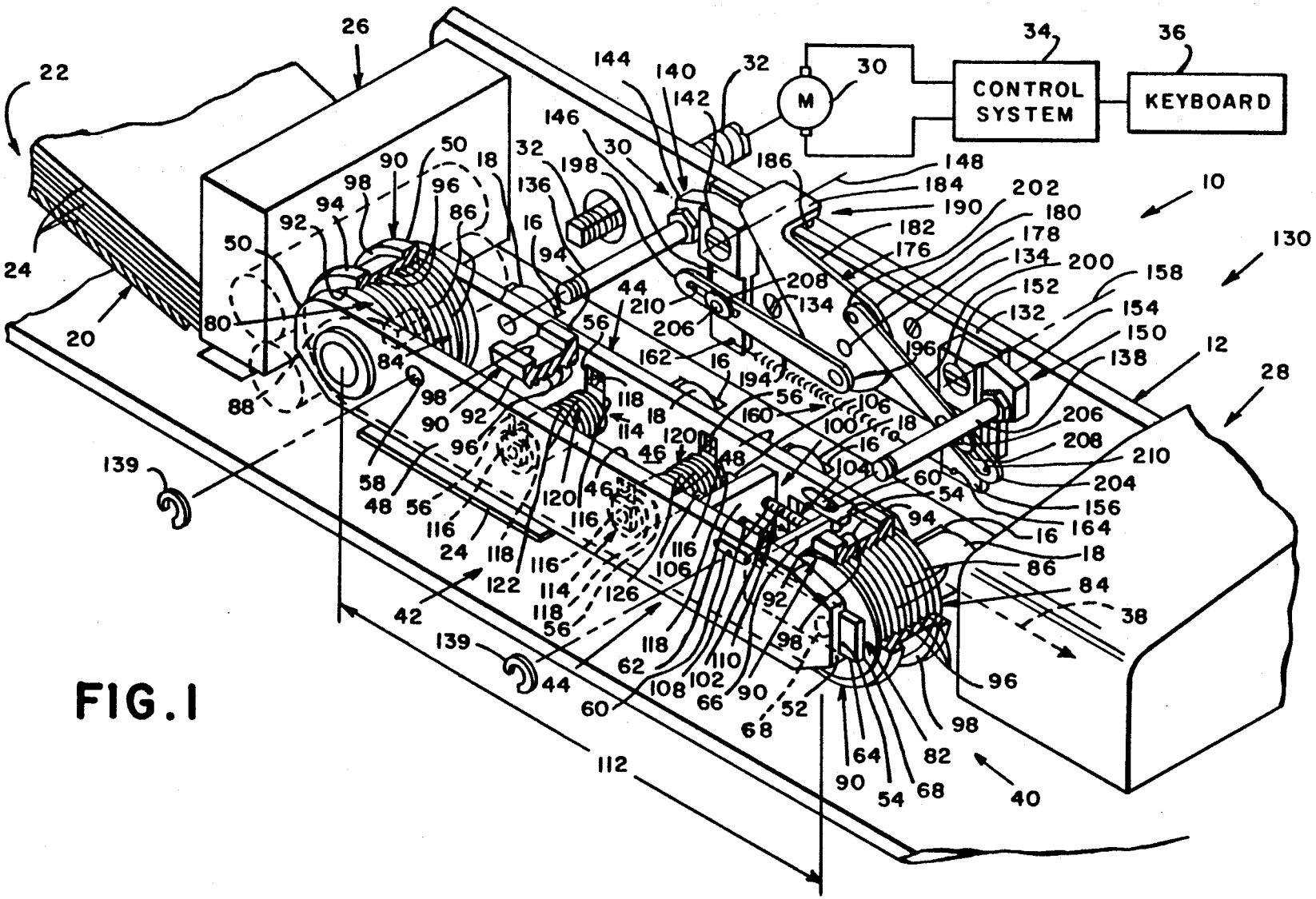
FIG. 1 is a partially schematic, partially exploded, view of apparatus according to t he invention, including letter feeding structure, a deck and structure for supporting the letter feeding structure over the deck.

As shown in FIG. 1, letter processing apparatus 10 according to the invention generally comprises suitable framework 12 for supporting the various components thereof including an elongate, generally rectangularly-shaped, deck 14 which may include a plurality of apertures 16 formed therein at intervals longitudinally of the length thereof. In addition, the apparatus 10 may include a plurality of idler rollers 18 which are conventionally rotatably connected to the framework 12 beneath the deck 14, at spaced intervals corresponding to the intervals between the deck apertures 16, for protrusion thereof upwardly through the deck apertures 16. Further, the apparatus 10 may include a conventional hopper 20 for receiving a stack 22 of letters 24, such as a stack of sealed or unsealed envelopes which may or may not be stuffed with one or more sheets, cards, remittance slips, forms, or the like, or any combination thereof, or a stack of one or more folded sheets or assemblies of folded or unfolded sheets, or a stack of sealed or unsealed mailpieces, or the like. In addition, the apparatus 10 may include conventional input feeding structure 26 for feeding letters 24 one at a time from the hopper 20 to the deck 14, such as any conventional singulating structure which is conventionally cooperatively associated with the hopper 20 for feeding the letters 24 therefrom and to the deck 14. Further, the apparatus 10 may include suitable printing structure 28 for printing indicia on respective letters 24, such as a conventional postage meter which is suitably removably connected to the framework 12 and supported thereby in overhanging relationship with respect to the deck 14 for printing postage or other indicia on respective letters 24 fed therebeneath on the deck 14. Moreover, the apparatus 10 includes a conventional motor 30, having a flexible output shaft 32 such as a tightly wound spring, includes a conventional control system 34, which is suitably connected to the motor 30, and includes an operator interface 36, such as a keyboard, which is suitably connected to the control system 34 for permitting an operator to provide conventional input to the control system 34 for starting and stopping the motor 30.

For feeding respective letters 24 (FIG. 1) on the deck 14 in a downstream path of travel 38 from the input feeding structure 26 and to and beneath the printing structure 28 the apparatus 10 includes letter feeding structure 40.

The letter feeding structure 40 (FIG. comprises a frame 42 including oppositely-spaced, elongate, generally rectangularly-shaped, side walls 44. Each of the side walls 44 has an inner surface 46 and an outer surface 48, and has an upstream end 50 and a downstream end 52. Further, each of the side walls 44 has a channel 54, which is formed therein from the inner surface 46 thereof and which partially extends longitudinally of the length of the side wall 44 from the downstream end 52 thereof. In addition, the side walls 44 each have formed therein, a first predetermined distance from each of the ends, 50 and 52, thereof, two generally rectangularly-shaped cavities 56, each of which extends partially into the inner surface 46 of the side wall 44. Moreover, the side walls 44 each have formed therein, a second predetermined from the upstream end 50 thereof, a substantially circularly-shaped upstream aperture 58, and, a third predetermined distance from the downstream end 52 thereof, a substantially rectangularly-shaped downstream aperture 60. Still further, the frame 42 includes a strut 62 which extends between the side walls 44 for spacing the walls 44 substantially parallel to one another, spacing the side wall channels 54 opposite and substantially parallel to one another, spacing each side wall cavity 56 opposite a side wall cavity 56 of the other side wall 44, and spacing each of the apertures, 58 and 60 respectively, of each side wall 44 opposite the apertures, 58 and 60 respectively, of the other side wall 44. Moreover, the frame 42 includes a yoke 64 which is substantially U-shaped in transverse cross-section and has a base portion 66 and opposed side portions 68 extending from the base portion 66. The yoke 64 is preferably dimensioned for slidably disposing the opposite side portions 68, respectively, in opposite side wall channels 54, such that the base portion 66 extends transversely between the side wall channels 54 and the side portions 68 extend from the base portion 64 toward the downstream ends 52. As thus constructed and arranged, the yoke 64 is disposed in sliding engagement with the side walls 44, and the side wall channels 54 act as a guide for sliding movement of the yoke 64, toward and away from the downstream ends 52 of the side walls 44, parallel to the longitudinal lengths of the side walls 44.

The letter feeding structure 40 (FIG. 1) also comprises a pair of axially parallel spaced, upstream and downstream rollers, 80 and 82, which extend between the side walls 44 of the frame 42 and are rotatably connected thereto. The upstream roller 80 is preferably directly rotatably connected to the opposite side walls 44 of the frame 42 adjacent to the upstream ends 50 of the side walls 44, for rotation in place. The downstream roller 82 is preferably carried by the yoke 64, and is thus directly rotatably connected to and between the opposite side portions 68 of the yoke 64, for rotation within the yoke 64 and sliding movement therewith toward and away from the downstream ends 52 of the side walls 44. Each of the rollers, 80 and 82, includes an outer surface 84 having formed therein a plurality of circumferentially-extending, parallel-spaced, ridges 86, which are serrated in transverse cross-section. And, the upstream roller 80 includes conventional structure 88 adapting the roller 80 for removable interconnection with the output shaft 32 of the motor 30. Further, the letter feeding structure 40 comprises an elongate, endless, belt 90 including elongate inner and outer surfaces, 92 and 94, respectively. The belt 90 is preferably made of a resilient material, such as rubber or synthetic rubber. And, the inner surface of the belt 90 has 92 formed therein a plurality of elongate, parallel-spaced, ridges 96 which are serrated is transverse cross-section. Preferably, the ridges 86 of each of the roller outer surfaces 84, and the ridges 96 the belt's inner surface 92 are dimensioned for meshing engagement with one another, to permit the belt 90 to be looped about the rollers, 82 and 84, for disposing the belt ridges 96 in meshing engagement with the ridges 86 of the respective rollers, 82 and 84. And, the belt outer surface 94 preferably includes an elongate channel 98 formed therein longitudinally of the length thereof.

For removably looping the belt 90 (FIG. 1) about the rollers, 82 and 84, the letter feeding structure 40 includes structure 100 for resiliently urging the yoke 64 towards the belt 90, to resiliently urge the downstream roller 82 carried by the yoke 64 into meshing engagement with the belt 90. The yoke urging structure 100 preferably includes at least one, and preferably a plurality of, such as two, coil springs 102, which are disposed between the strut 62 and yoke 64 and biased for urging the yoke 64 away from the strut 62 and towards the belt 90. For preventing the yoke side portions 68 from being urged out of alignment with the side wall channels 54, and thereby preventing the yoke 64 and thus the roller 84 from being urged into jamming relationship with the side walls 44. The yoke urging structure 100 includes structure 104 for guiding expansion and contraction of each spring 102, including an elongate rod or rod-like member 106, which is fixedly connected to or integrally formed with the yoke base portion 66 so as to extend therefrom substantially parallel to the longitudinal lengths of the side walls 44, towards the strut 62. In addition, the strut 62 includes an aperture 108 formed therein, for each of the members 106, which is dimensioned for slidably receiving and guiding movement of the member 106. And, each of the springs 102 is mounted on a different rod member 106 for guiding expansion and contraction of the spring 102 in the direction of movement of the rod member 106. As thus constructed and arranged, the force(s) 110 exerted by the spring(s) 102, against the yoke 64 are exerted substantially parallel to the longitudinal lengths of the side walls for moving the yoke 64 in alignment with the longitudinal lengths of the side wall channels 54. And the belt 90 may be mounted on and dismounted from the rollers, 82 and 84, by initially manually compressing the downstream roller 84 towards the strut 62, against the force(s) 110 exerted by the springs(s) 102, then manually looping the belt 90 about, or removing the belt 90 out of looping relationship with respect to, the rollers, 82 and 84, and then manually releasing compression of the downstream roller 84.

Assuming the belt 90 (FIG. 1) is looped about the rollers, 82 and 84, the force(s) 110 exerted by the spring(s) 102 against the yoke 64, cooperate with the belt tension created thereby to hold the rollers, 82 and 84, and belt 90 in engagement with one another. As thus configured, the belt 90 includes a lower belt run 112 extending between the upstream and downstream rollers, 82 and 84, for engaging and feeding letters 24 fed to the deck 14. Preferably, for maintaining the lower belt run 112 in feeding engagement with varying thicknesses of letters 24 on the deck 14, the letter feeding structure 40 includes a pair of axially parallel spaced idler rollers 114, which are rotatably connected to the side walls 44 at spaced intervals between the upstream and downstream rollers, 82 and 84. For rotatably connecting the rollers, 82 and 84, to the side walls 44, the letter feeding structure 40 includes a generally rectangularly-shaped member 116, which is slidably mounted for vertical movement thereof in each of the side wall cavities 56, and includes a spring 118 which is mounted in each of the cavities 56 and biased for urging the member 116 associated therewith downwardly, and thus towards the lower belt run 112. And, each of the idler rollers 114 is conventionally journaled for rotation to the slide members 116 mounted within oppositely disposed side wall cavities 56. As thus constructed and arranged, the springs 118 resiliently urge the slide members 116 towards the lower belt run 112, for resiliently maintaining the idler rollers 114 in rolling engagement with the lower belt run 112. Without departing from the spirit and scope of the invention, the circumferentially-extending outer surface 120 of each of the idler rollers 114 may include a plurality of parallel-spaced ridges 122 which are serrated in transverse cross-section and dimensioned for disposition in meshing engagement with the ridges 96 of the inner surface 96 of the belt 90.

For removably connecting the letter feeding structure 40 (FIG. 1) to the apparatus 10, the apparatus 10 includes structure 130 for supporting the letter feeding structure 40 in overhanging relationship with respect to the deck 14.

The supporting structure 130 includes a stationary frame 132 which is preferably conventionally removably fixedly attached to the framework 12, for replacement purposes, as by means of a plurality of suitable fasteners 134 such as screws. In addition, the supporting structure 130 includes elongate, parallel-spaced, upstream and downstream support members, 136 and 138, which are respectively pivotally attached to the frame 132 so as to extend substantially horizontally therefrom and into overhanging relationship with respect to the deck 14. And the support members, 136 and 138, are dimensioned to extend through the respective upstream and downstream side walls apertures, 58 and 60, of the frame 42 of the letter feeding structure 46 for removably supporting the structure 40 on the support members, 136 and 138. For removably holding the letter feeding structure 40 in place on the supporting members, 136 and 138, the supporting structure 130 may include suitable removable fasteners, such as respective C-clamps 139 which are conventionally removably connected to the ends of each of the support members, 136 and 138. For pivotally attaching the upstream support member, 136 to the frame 132, the supporting structure 130 includes an upstream bell crank lever 140, which is conventionally pivotally attached to the frame 132, as by means of an upstream pin 142. The upstream lever 140 includes a first arm 144 which extends upstream from, and a second arm 146 which depends from, the commonly shared, predetermined, upstream pivot axis 148 of the pin 142. And, the upstream support member 136 is conventionally fixedly attached to the first, upstream, arm 144 for pivotable movement therewith relative to the frame 132. For pivotally attaching the downstream support member 138 to the frame 132, the supporting structure 130 includes a downstream bell crank lever 150, which is conventionally pivotally attached to the frame 132, as by means of a downstream pin 152. The downstream lever 150 includes a first arm 154 which extends downstream from, and a second arm 156 which depends from, the commonly shared, predetermined, downstream, pivot axis 158 of the pin 152. And the downstream support member 138 is conventionally fixedly attached to the first, downstream, arm 154 for pivotable movement therewith relative to the frame 132.

For resiliently urging the support members, 136 (FIG. 3) and 138, and thus the letter feeding structure 40 carried thereby, downwardly and into either feeding relationship with respect to letters 24 on the deck 14, the support structure 130 includes a coil spring 160 having opposed upstream and downstream ends, 162 and 164, which are respectively connected to the lower ends of the depending bell crank lever arms, 146 and 156, and biased for resiliently urging the lever arms, 146 and 156, toward each other. As result the upstream and downstream and downstream support members, 136 and 138, carried thereby, are urged towards the deck 14 to carry the letter feeding structure 40 therewith and resiliently urge the lower belt run 112 thereof into feeding relationship with respective letters 24 fed to the deck 14. Preferably, the spring 160 and upstream bell crank lever 140 cooperate with one another to cause the upstream support member 136 to exert a substantially vertically downwardly oriented force 168 (FIG. 2) against the letter feeding structure 40, and thus against the upstream roller 80, whereby the upstream end of the lower belt run 112 is resiliently urged into feeding relationship with respective letters 24 fed therebeneath on the deck 14. And, the spring 160 and the downstream bell crank lever 150 cooperate with one another to cause the downstream support member 138 to exert a substantially vertically downwardly oriented force 170 against the letter feeding structure 40, and thus against the downstream roller 82, whereby the downstream end of the lower belt run 112 is resiliently urged into feeding relationship with respective letters 24 fed therebeneath on the deck 14.

For raising the letter feeding structure 40 (FIG. 2) out of feeding relationship with respective letters 24 on the deck 14, to facilitate mounting the letter feeding structure 40 on the support members, 136 and 138, dismounting the letter feed structure 40 therefrom and clearing, from beneath the lower belt run 112, a letter 24 (FIG. 3) jammed between the belt run 112 and deck 14, the supporting structure 130 (FIG. 2) preferably includes a crank member 176 which is conventionally pivotally connected to the frame 132, as by means of a suitable pin 178 located substantially mid-way between the depending bell crank lever arms, 146 and 156. The crank member 176 includes a partially circularly-shaped lower end portion 180, having an axis of rotation which is coincident with the axis of the which upwardly extends from the lower end portion 180. The upper arm portion 182 has a free end 184 including a finger portion 186 thereof, which laterally extends from the upper arm portion 182 and acts as a stop for restricting pivotal movement of the free end 184 between an upstream stop position 190 (FIG. 2), wherein the finger portion 186 engages the frame 132 to prevent further rotation thereof towards the upstream bell crank lever 140, and a downstream stop position 192 (FIG. 3), wherein the finger portion 186 engages the frame 132 to prevent further rotation thereof towards the downstream bell crank lever 150. In addition, the supporting structure 130 includes a first elongate link 194, having one end 196 thereof conventionally pivotally attached to the lower end portion 180 of the crank member 176, as by means of a pin 197, and the other end 198 thereof movably attached to the depending lever arm 146 of the upstream bell crank lever 140. Further, the supporting structure 130 includes a second elongate link 200 having one end 202 thereof conventionally pivotally attached to the lower end portion 180 of the crank member 176, as by means of a pin 203, and having the other end 204 thereof movably attached to the depending lever arm 156 of the downstream bell crank lever 150. Preferably, the link pins 197 and 203, are located on opposite sides of the crank members pivot pint 178. For movable attachment of the respective links, 194 and 200, to the respective depending bell crank lever arms, 146 and 156, each of the depending lever arms, 146 and 156, has a post 206 extending substantially horizontally therefrom, each of the links, 194 and 200, has a generally rectangularly-shaped aperture 210 formed therein for receiving one of the posts 206 therethrough and in sliding relationship therewith, and each of the posts 206 has a stop 208 connected to the outer end thereof for holding the associated link, 194 or 200, in movable relationship with respect to the post 206.

Figure 2:
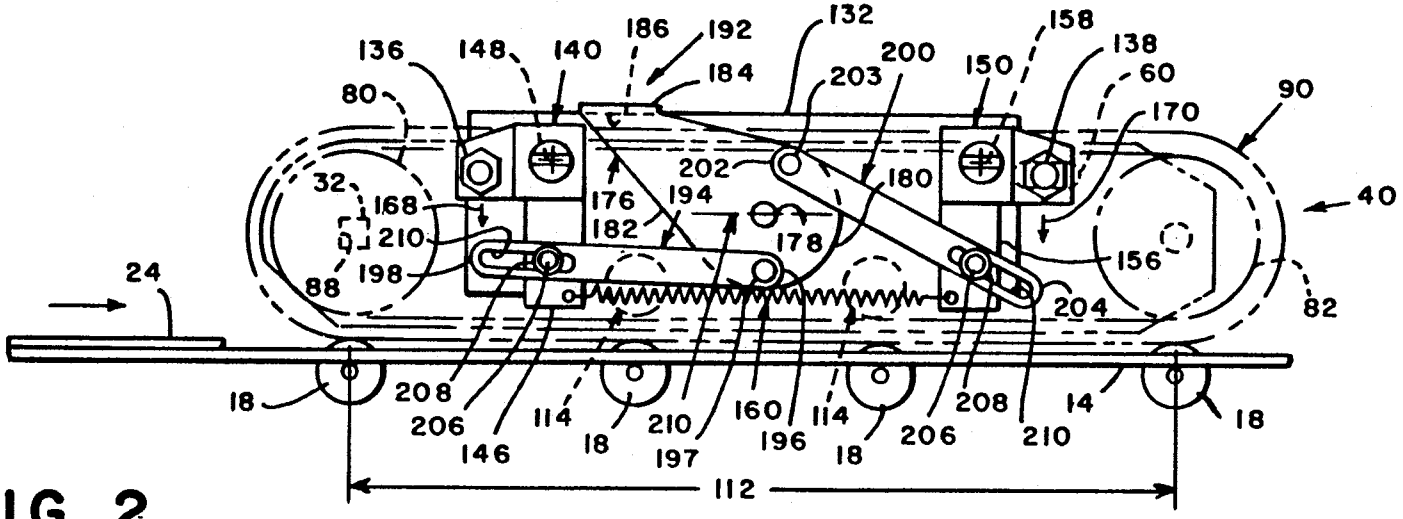
FIG. 2 is an elevation view of the letter feeding structure and deck of FIG. 1, showing the feeding structure positioned in letter feeding relationship with respect to the deck.
Figure 3:
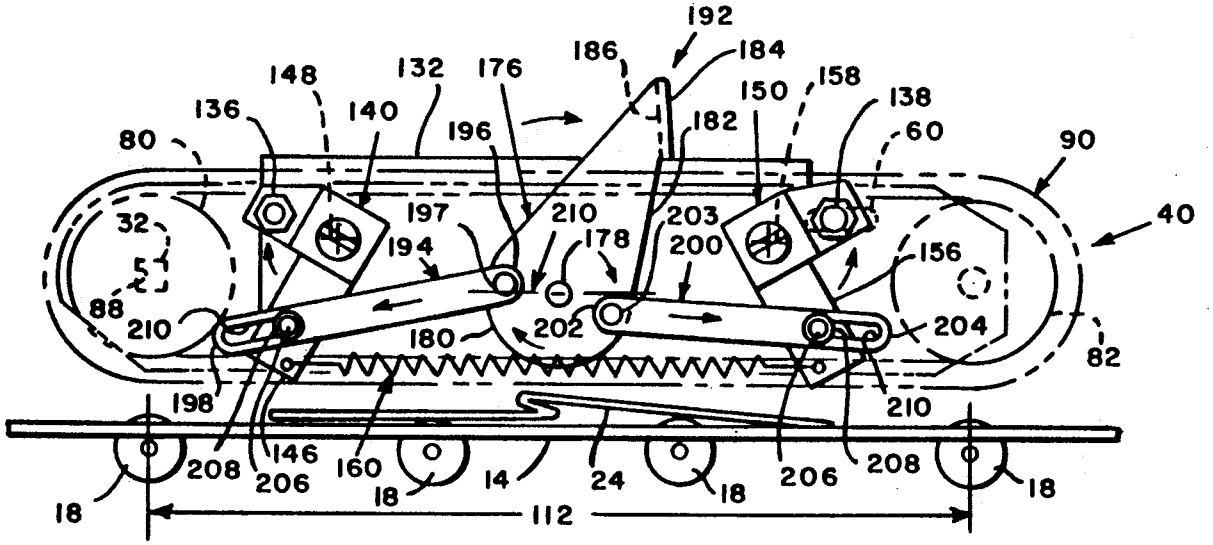
FIG. 3 is an elevation view, similar to FIG. 2, showing the letter feeding structure positioned out of letter feeding relationship with respect to the deck.

As shown in FIG. 2, when the letter feeding structure 40 is disposed in feeding relationship with respect to letters 24 on the deck 14, the crank member's free end 184 is located in the upstream stop position 190 thereof, and the link pivot pins, 197 and 203, are respectively located below and above a centerline 210 extending substantially horizontally through the axis of the crank member pivot pin 178. Moreover, the bell crank lever arm posts 206 are respectively slidable, either toward or away from the associated link ends, 198 or 204, within the link apertures 210, as letters 24 of varying thicknesses engaged by the belt run 112 cause the support members, 136 and 138, to be raised or lowered, against the resilient forces, 168 and 170, caused by the bell crank levers, 140 and 150 rotating and moving the posts 206 therewith. In the course of manually pivoting the crank member's free end 184 from the upstream stop position 190 thereof to the downstream stop position 192 thereof, the link pivot pins, 197 and 203, are respectively arcuately moved upwardly and downwardly across the centerline 210. Accordingly, as shown in FIG. 3, when the letter feeding structure 40 is disposed out of feeding relationship with respect to letters 24 on the deck 14, the crank member's free end 184 is located in the downstream stop position 192 thereof, and the link pivot pins, 197 and 203, are respectively located above and below the centerline 210 extending through the axis of the crank member's pivot pin 178. Moreover, the respective links 194 and 200, are resiliently urged by the spring 160 into engagement with the bell crank lever arm posts 206 for holding the respective bell crank depending lever arms, 146 and 156, away from each other to hold the respective support members, 136 and 138, in a raised position wherein the connected letter feeding structure 40 is located out of feeding relationship with respect to letters 24 on the deck 14.

In accordance with the objects of the invention there has been described simplified apparatus for processing mixed thickness letters. And there has been described letter feeding apparatus which is removably connectable to structure for supporting the letter feeding apparatus including structure for clearing letter jam conditions. Moreover, there has been described an article of manufacture for use in letter processing apparatus.

What is claimed is:

1. Apparatus for processing letters, comprising:

a. an elongate deck;

b. means for feeding respective letters in a downstream path of travel extending longitudinally along the deck, the feeding means including a pair of axially parallel spaced rollers, the feeding means including an endless belt looped about the rollers and disposed in engagement therewith; and c. means for supporting the feeding means, the supporting means including a stationary frame, the supporting means including a pair of elongate parallel-spaced support members overhanging the deck, the supporting means including an upstream lever and a downstream lever, each of the levers attached to the frame for pivoting about a predetermined axis thereof, one of the support members fixedly attached to one of the levers for movement therewith and the other support member fixedly attached to the other lever for movement therewith, means for positioning each of the levers, the positioning means operable for positioning each of the levers in a first predetermined position thereof, and the supporting means including means for resiliently urging the feeding means toward the deck when the levers are positioned in the first predetermined positions thereof.

2. The apparatus according to claim 1, wherein the positioning means is operable for positioning each of the levers in a second predetermined position thereof wherein the feeding means is removably connectable to the support members.

3. The apparatus according to claim 1, wherein each of levers is a bell crank lever including first and second arms sharing the pivot axis thereof, the one support member fixedly attached to the first lever arm of one of the bell crank levers, the other support member fixedly attached to the first lever arm of the other bell crank lever, and the positioning means connected to each of the second lever arms.

4. The apparatus according to claim 3, wherein the positioning means includes a spring connected between the second lever arms for resiliently urging the support members towards the deck.

5. The apparatus according to claim 3, wherein one of the levers is an upstream lever and the other lever is a downstream lever, the positioning means including a crank member rotatably attached to the frame between the levers, the positioning means including a first link extending between the crank member and the upstream lever, the positioning means including a second link extending between the crank member and the downstream lever, and the crank member adapted to be manually operated for positioning each of the levers in the first position thereof.

6. The apparatus according to claim 5, wherein the crank member is adapted to be manually operated for positioning each of the levers in a second predetermined position thereof wherein the feeding means is removably connectable to the support member.

7. Apparatus for processing letters, comprising:

a. an elongate deck;

b. means for feeding respective letters in a downstream path of travel extending longitudinally along the deck, the feeding means including a pair of axially parallel spaced rollers, the feeding means including an endless belt looped about the rollers and disposed in engagement therewith; and c. means for supporting the feeding means, the supporting means including a stationary frame, the supporting means including a pair of elongate parallel-spaced support members overhanging the deck, the supporting means including an upstream lever and a downstream lever, each of the levers attached to the frame for pivoting about a predetermined axis thereof, one of the support members fixedly attached to one of the levers for movement therewith and the other support member fixedly attached to the other lever for movement therewith, means for positioning each of the levers, and the positioning means operable for positioning each of the levers in a first predetermined position thereof wherein the feeding means is removably connectable to the support members.

8. The apparatus according to claim 7, wherein each of levers is a bell crank lever including first and second arms sharing the pivot axis thereof, the one support member fixedly attached to the first lever arm of one of the bell crank levers, the other support member fixedly attached to the first lever arm of the other bell crank lever, and the positioning means connected to each of the second lever arms.

9. The apparatus according to claim 8, wherein the positioning means includes a spring connected between the second lever arms for resiliently urging the support members towards the deck.

10. The apparatus according to claim 8, wherein one of the levers is an upstream lever and the other lever is a downstream lever, the positioning means including a crank member rotatably attached to the frame between the levers, the positioning means including a first link extending between the crank member and the upstream lever, the positioning means including a second link extending between the crank member and the downstream lever, and the crank member adapted to be manually operated for positioning each of the levers in the first position thereof.

11. The apparatus according to claim 10, wherein the crank member is adapted to be manually operated for positioning each of the levers in a second predetermined position thereof wherein the feeding means is resiliently urged towards the deck.

12. An article of manufacture for use in letter processing apparatus, the article comprising:

a. an upright frame adapted to be fixedly connected to letter processing apparatus;

b. pair of elongate parallel-spaced support members;

c. an upstream lever and a downstream lever, each of the levers attached to the frame for pivotal movement about a predetermined axis thereof, one of the support members fixedly attached to one of the levers for movement therewith and the other support member fixedly attached to the other lever for movement therewith, means for positioning the levers, the positioning means operable for positioning each of the levers in a first predetermined position thereof; and d. means for resiliently urging each of the support members downwardly when the levers are in the first predetermined positions thereof.

13. The apparatus according to claim 12, wherein the positioning means is operable for positioning each of the levers in a second predetermined position thereof, and the means for resiliently urging urges the support members upwardly when the levers are positioned in the second predetermined positions thereof.

14. The apparatus according to claim 12, wherein each of levers is a bell crank lever including first and second arms sharing the pivot axis thereof, the one support member fixedly attached to the first lever arm of one of the bell crank levers, the other support member fixedly attached to the first lever arm of the other bell crank lever, and the positioning means connected to each of the second lever arms.

15. The apparatus according to claim 14, wherein the positioning means includes a spring connected between the second lever arms.

16. The apparatus according to claim 14, wherein the positioning means includes a crank member rotatably attached to the frame between the levers, the positioning means including a first link extending between the crank member and one of the second lever arms, the positioning means including a second link extending between the crank member and the other second lever arm, and the crank member adapted to be manually operated for positioning the links and thus the second lever arms.

* * * * *